US009416719B2

(12) United States Patent
Grussmann

(10) Patent No.: US 9,416,719 B2
(45) Date of Patent: Aug. 16, 2016

(54) EXHAUST MANIFOLD WITH INSULATION SLEEVE

(71) Applicant: BENTELER AUTOMOBILTECHNIK GMBH, Paderborn (DE)

(72) Inventor: Elmar Grussmann, Altenbeken-Buke (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 14/455,307

(22) Filed: Aug. 8, 2014

(65) Prior Publication Data

US 2015/0059324 A1 Mar. 5, 2015

(30) Foreign Application Priority Data

Aug. 30, 2013 (DE) ..... 10 2013 109 446

(51) Int. Cl.
*F01N 1/00* (2006.01)
*F01N 13/10* (2010.01)
*F01N 13/18* (2010.01)

(52) U.S. Cl.
CPC ..... *F01N 13/102* (2013.01); *F01N 13/1805* (2013.01); *F01N 13/185* (2013.01); *F01N 13/1872* (2013.01); *F01N 13/1888* (2013.01); *F01N 2450/20* (2013.01); *F01N 2450/22* (2013.01); *F01N 2470/26* (2013.01)

(58) Field of Classification Search
CPC ..... F01N 3/046; F01N 3/043; F01N 13/102; F01N 13/10; F02B 37/02
USPC ..... 60/324, 320, 321, 323
See application file for complete search history.

(56) References Cited

U.S. PATENT DOCUMENTS 4,197,704 A * 4/1980 Date ..... F01N 13/14 60/282
5,419,127 A * 5/1995 Moore, III ..... F01N 13/102 60/322
6,155,046 A * 12/2000 Kato ..... F01N 13/102 60/322
6,555,070 B1 * 4/2003 Kruger ..... F01N 3/2853 422/177
7,198,459 B2 4/2007 Grussmann et al.

(Continued)

FOREIGN PATENT DOCUMENTS

CN 101243244 A 8/2008
CN 101473118 A 7/2009

(Continued)

OTHER PUBLICATIONS

European Search Report issued on Dec. 15, 2014 with respect to counterpart European patent application EP 14 16 6302.

(Continued)

*Primary Examiner* — Patrick Maines
(74) *Attorney, Agent, or Firm* — Henry M. Feiereisen LLC.

(57) ABSTRACT

An exhaust manifold for a combustion engine of a motor vehicle includes a two-shell construction comprised of an outer system and an inner system. A flange is positioned at a side proximal to a cylinder head of the combustion engine for installation to the combustion engine, and an insulation sleeve connects the inner system with the flange and the outer system. The insulation sleeve is sized to extend through an opening of the flange and to project beyond the flange into the cylinder head of the combustion engine.

10 Claims, 3 Drawing Sheets

(56) References Cited

U.S. PATENT DOCUMENTS

| | | | | |
|---|---|---|---|---|
| 8,104,273 | B2 * | 1/2012 | Barrieu | F01N 13/102 29/890.08 |
| 8,196,302 | B2 * | 6/2012 | Nording | F01N 13/1811 123/65 EM |
| 8,291,698 | B2 * | 10/2012 | Hikami | F01N 13/102 181/200 |
| 8,312,721 | B2 | 11/2012 | Smatloch et al. | |
| 8,382,429 | B2 | 2/2013 | Grussmann et al. | |
| 8,549,851 | B2 | 10/2013 | Grussmann et al. | |
| 8,628,296 | B2 | 1/2014 | Grussmann et al. | |
| 8,667,679 | B2 | 3/2014 | Smatloch et al. | |
| 8,726,655 | B2 | 5/2014 | Smatloch et al. | |
| 2004/0226291 | A1 * | 11/2004 | Diez | F01N 3/2882 60/323 |
| 2009/0158724 | A1 * | 6/2009 | Muller | F01N 13/102 60/323 |
| 2011/0252775 | A1 * | 10/2011 | Joergl | F01D 25/145 60/321 |
| 2011/0286837 | A1 | 11/2011 | Smatloch et al. | |
| 2011/0308238 | A1 * | 12/2011 | Grussmann | F01N 13/10 60/323 |
| 2012/0294709 | A1 | 11/2012 | Grussmann | |
| 2013/0064655 | A1 | 3/2013 | Smatloch et al. | |
| 2013/0064656 | A1 | 3/2013 | Smatloch et al. | |

FOREIGN PATENT DOCUMENTS

| | | | |
|---|---|---|---|
| DE | 102 20 986 | | 11/2003 |
| EP | 0 171 624 | | 2/1986 |
| JP | S 60-87329 | U | 6/1985 |
| JP | 2003-172136 | A | 6/2003 |
| JP | 2003172136 | A * | 6/2003 |

OTHER PUBLICATIONS

Translation of European Search Report issued on Dec. 15, 2014 with respect to counterpart European patent application EP 14 16 6302.

Chinese Search Report issued on May 26, 2016 with respect to counterpart Chinese patent application 201410293298X.

Translation of Chinese Search Report issued on May 26, 2016 with respect to counterpart Chinese patent application 201410293298X.

* cited by examiner

EXHAUST MANIFOLD WITH INSULATION SLEEVE

CROSS-REFERENCES TO RELATED APPLICATIONS

This application claims the priority of German Patent Application, Serial No. 10 2013 109 446.5, filed Aug. 30, 2014, pursuant to 35 U.S.C. 119(a)-(d), the disclosure(s) of which is/are incorporated herein by reference in its entirety as if fully set forth herein.

BACKGROUND OF THE INVENTION

The present invention relates to an exhaust manifold for installation in a combustion engine of a motor vehicle.

The following discussion of related art is provided to assist the reader in understanding the advantages of the invention, and is not to be construed as an admission that this related art is prior art to this invention.

Exhaust manifolds are coupled to a combustion engine to centralize exhausts generated during combustion and to release the exhaust to the surroundings. An exhaust manifold is typically produced by bending various tubes which are connected to flanges, and then threadably engaged on one side of the cylinder head and coupled with the exhaust tract on the other side. During the combustion process, especially when a combustion engine is a fuel-operated Otto engine, temperatures of the exhaust may reach more than 1200° C.

It would be desirable and advantageous to provide an improved exhaust manifold to obviate prior art shortcomings.

SUMMARY OF THE INVENTION

According to one aspect of the present invention, an exhaust manifold for a combustion engine of a motor vehicle includes a two-shell construction comprised of an outer system and an inner system, a flange positioned at a side of the two-shell construction proximal to a cylinder head of the combustion engine for installation to the combustion engine, and an insulation sleeve configured to connect the inner system with the flange and the outer system, the insulation sleeve being sized to extend through an opening of the flange and to project beyond the flange into the cylinder head of the combustion engine.

In accordance with the present invention, the term "flange" is used in the description in a generic sense and may involve a dedicated flange for each cylinder of the combustion engine of the motor vehicle, i.e. each cylinder has a dedicated flange, or a flange rail may be involved which, for example in the case of a four-cylinder in-line engine, has four openings. Each flange or each opening is associated to an insulation sleeve which extends through the opening of the flange and is sized to project out at the side of the cylinder head in the direction of the combustion engine so that discharged exhausts can be received already in the outlet channel of the cylinder head and transferred to the inner system of the exhaust manifold.

Thus, in accordance with the present invention, the insulation sleeve is used to provide a thermal relief of both the flange and the outer system. At the same time, the provision of the insulation sleeve enables a coupling of outer system, flange and inner system with one another so that installation of the various components is simplified as these components are jointly connected to a single structure. Advantageously, the various connections can be realized by a soldering process so that the insulation sleeve is soldered to the various components and then manufactured in a soldering process, for example in a soldering furnace, in the area of the components. As a result, the need for several welding operations is eliminated and/or contamination of exhaust-conducting components by welding additives or welding splatter is avoided.

The provision of an exhaust manifold with insulation sleeve in accordance with the present invention thus reduces during operation of the combustion engine temperature stress on the outer shell and draws as little as possible energy from the exhaust. Another benefit involves a downstream catalytic converter which reaches its ignition temperature more rapidly which in turn results in low emission during the cold start phase. This is especially beneficial, when self-ignition combustion engines are involved, for example Diesel engines, because after-injection for example to reduce emission is only possible to a limited extent and would also adversely affect consumption. Insulation is thus primarily established by the air gap between the insulation sleeve and the inner system and towards the cylinder head. In addition, a direct heat conduction is reduced as a result of the reduced cross sectional area at the connection of inner pipe to insulation sleeve.

According to another advantageous feature of the present invention, the insulation sleeve can have a wall thickness of less than 2 mm. Currently preferred is a wall thickness of less than 1.5 mm for the insulation sleeve. To improve the insulation effect between inner system and insulation sleeve, it is, optionally, also possible to use additional insulating material, for example a fiber mat.

According to another advantageous feature of the present invention, the insulation sleeve can be disposed in circumferential surrounding relationship to the inner system. Advantageously, the insulation sleeve may be connected to the inner system by a press fit. Thus, during initial assembly, it is possible to slide the insulation sleeve into the inner system or to slide the insulation sleeve over the inner system, with the press fit establishing a secure positioning and fixation. Different heat expansions of the inner system, especially in the area of the opening of the flange, when the inner system is configured in the form of a pipe sized to extend into the flange, can thus be compensated by the press fit such that the inner system can expand to a greater extent than the insulation sleeve as a result of the direct contact of the inner system with the exhaust gas. Thus, gas tightness is established at any time between the inner system and the insulation sleeve in the outlet channel of the cylinder head.

According to another advantageous feature of the present invention, the outer system has an end face which can abut an outside of the flange, with the insulation sleeve contacting an inner surface area of the opening of the flange by a form fit. The insulation sleeve traverses the flange and has at least one area which extends out also on the outer side of the flange. Advantageously, the insulation sleeve is surrounded by the outer system such that a press fit is established. The press fit is realized especially between an inner surface area of the outer system and the outer surface area of the insulation sleeve. Also in this way, the outer system can be placed over the insulation sleeve during initial assembly, with the press fit establishing a reliable fixation and positioning. Additional coupling can be realized for example by a material joint, e.g. soldering process, by which the outer system and the insulation sleeve and the insulation sleeve and the flange and, optionally the outer system and the flange, are additionally coupled by a material joint.

According to another advantageous feature of the present invention, the insulation sleeve can be configured as a formed sheet metal part, e.g. a deep-drawn sheet metal part. This has the advantage that the insulation sleeve is free from any weld seam and thus does not have any potential weak point when exposed to thermal stress. The use of a deep-drawn part is further advantageous because of the possibility to use a material that is heat-resistant and yet inexpensive while still being freely malleable. For example, the insulation sleeve may be configured with at least one stepped shoulder, advantageously at least two stepped shoulders, in an axial direction defined by a central longitudinal axis, to thereby provide a formfitting contact and/or a solder deposit. With respect to its cross section, the insulation sleeve has thus a funnel-shaped contour and the cross section of the insulation sleeve may be round, oval, or polygonal, or a combination thereof. The respective stepped shoulders may be shaped gradually progressively, degressively or feed into one another incrementally and may be used as installation aid or as solder deposit so that solder material can initially be applied and flow into respective recesses, seats or grooves during a subsequent soldering process to provide gas tightness and coupling by a material joint.

According to another advantageous feature of the present invention, the insulation sleeve and the inner system can bound, at least in one area, a circumferential gap there between, with the gap being filled with air or an insulating material. Advantageously, the insulation sleeve is coupled with the inner system only in the inner region upon the cylinder head or on the part of the inner system that projects into the cylinder head. A gap is then formed in a direction facing away from the cylinder head, i.e. in a direction towards the exhaust manifold, so that the inner system is thermally insulated from the insulation sleeve. The insulation sleeve is thus coupled with the flange and the outer system to thereby establish a thermal decoupling. Different heat expansions of the inner system have therefore no direct effect on the flange and/or the outer system and there is the advantage that gas tightness of the entire exhaust manifold is realized as a result of the coupling of the insulation sleeve with the outer system and/or with the flange, without encountering any significant thermal impact.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
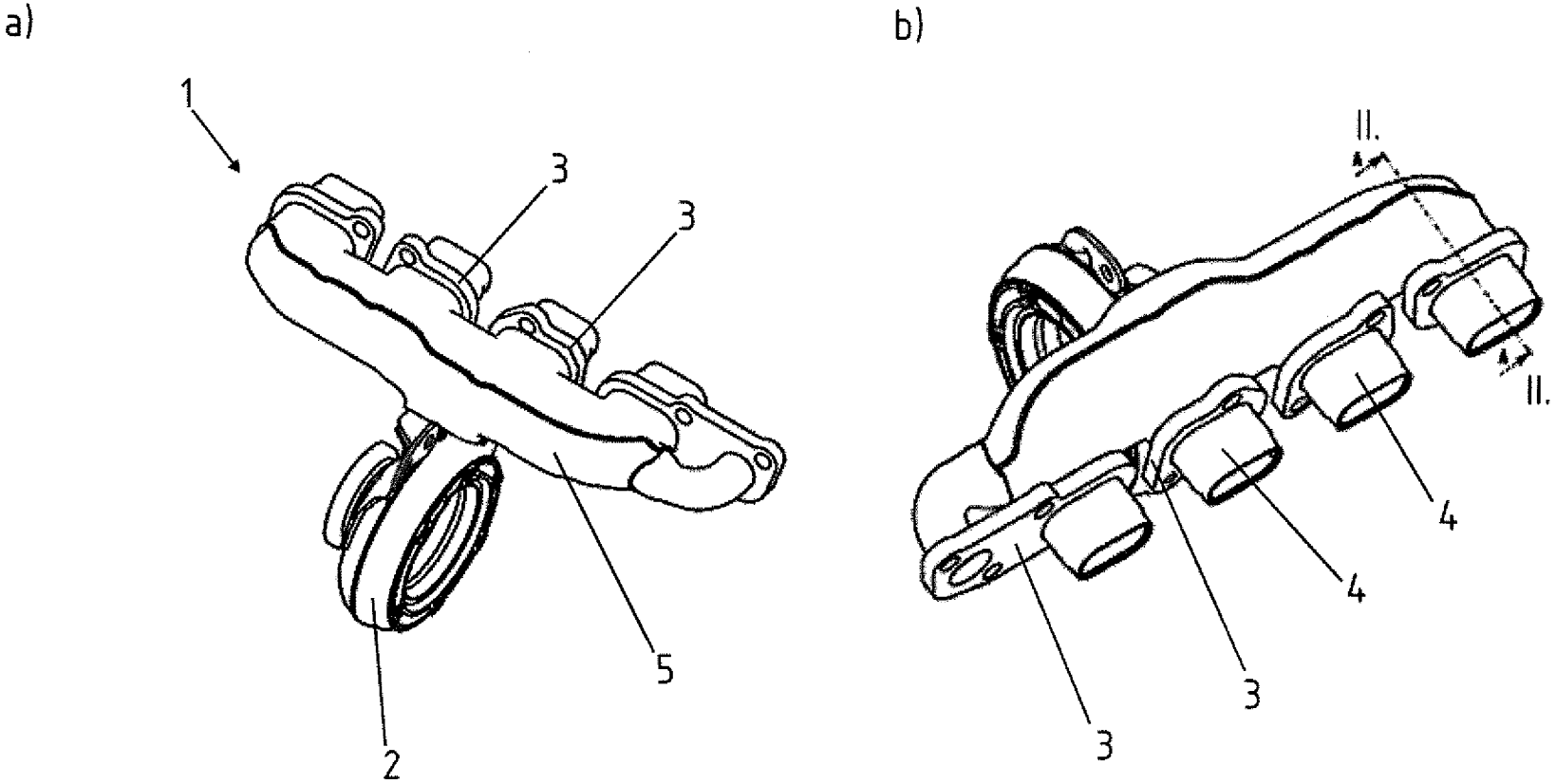
FIG. 1*a* is a perspective view of an exhaust manifold according to the present invention from one side.
FIG. 1*b* is a perspective view of the exhaust manifold from another side.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
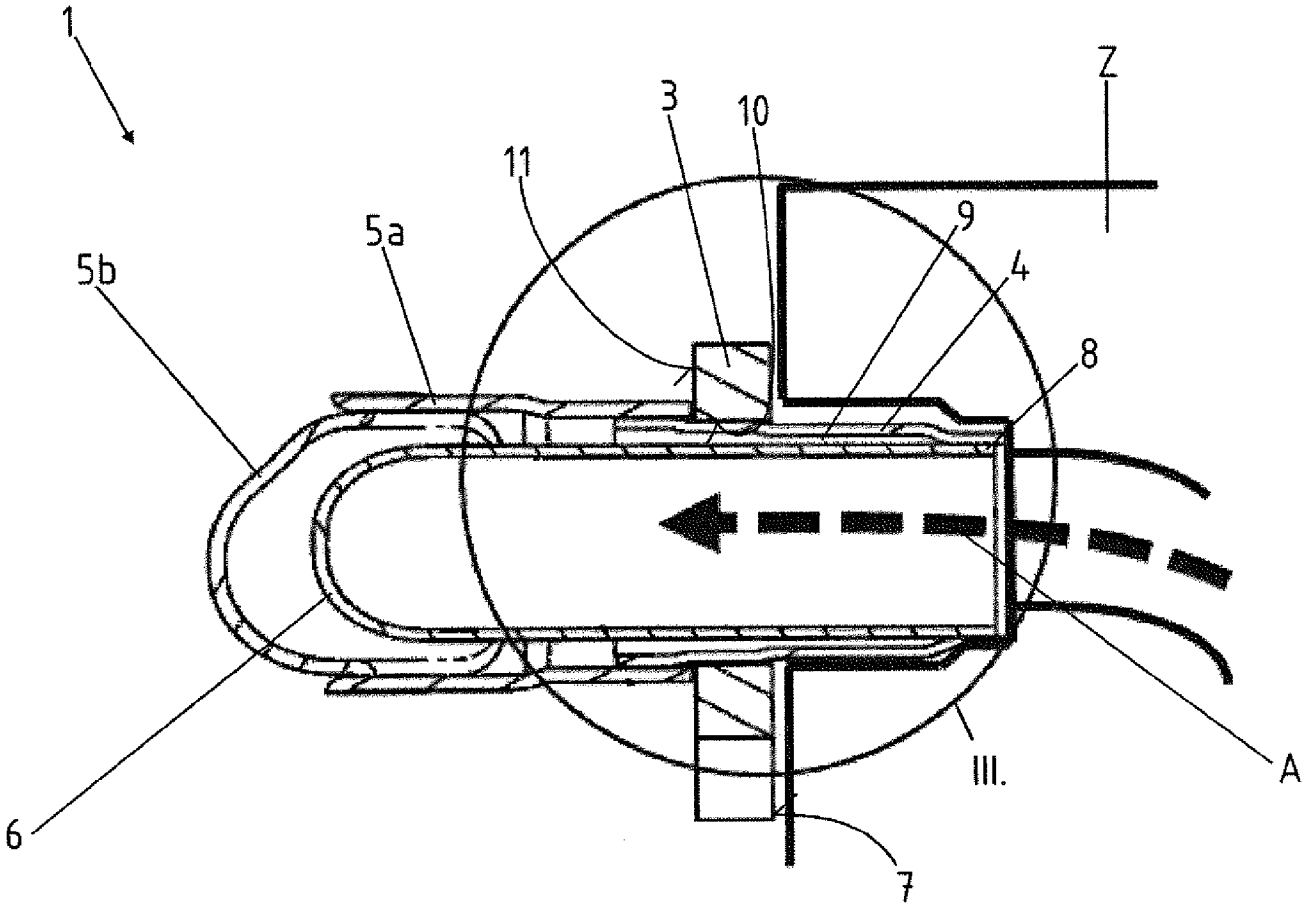
FIG. 2 is a cross sectional view of the exhaust manifold, taken along the line II-II in FIG. 1*b.

Turning now to the drawing, and in particular to FIGS. 1*a*, 1*b*, there are shown perspective views of an exhaust manifold according to the present invention, generally designated by reference numeral 1 and constructed for coupling to a part of a housing of a turbocharger 2. Such a turbocharger 2 forms with the pertaining exhaust manifold 1 an integrated assembly. The exhaust manifold 1 has flanges 3 for coupling the exhaust manifold 1 to a cylinder head Z (FIG. 2). Each of the flanges 3 has an opening 10, shown in FIG. 2, which is traversed by an insulation sleeve 4. The insulation sleeve 4 is sized to extend beyond the flange 3 in a direction of the cylinder head Z. The exhaust manifold 1 includes a multi-shell outer system 5 in which an inner system 6 (FIG. 2) is arranged but not shown in greater detail in FIGS. 1 *a*, 1*b*. Although not shown in the drawings, the inner system 6 may also have a multi-shell configuration.

Figure 3:
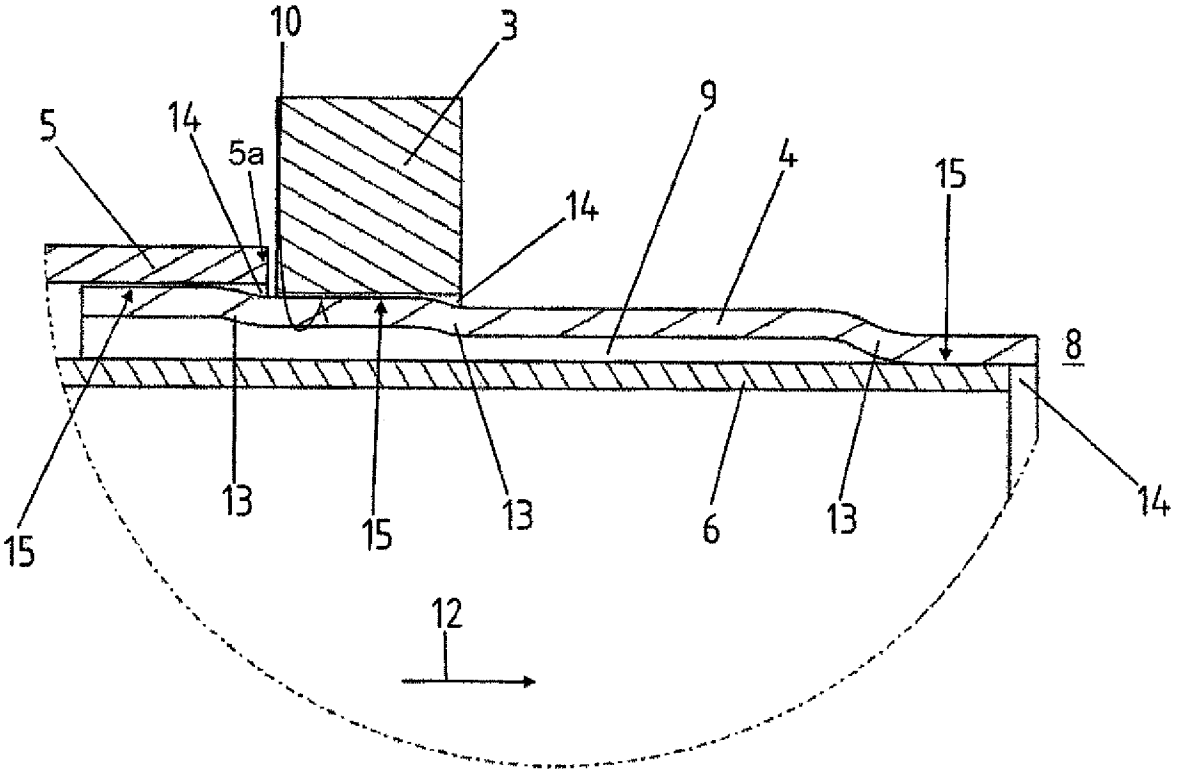
* and FIG. 3 is an enlarged detailed view of the area encircled in FIG. 2 and marked III.

FIG. 2 is a cross sectional view of the exhaust manifold, taken along the line II-II in FIG. 1*b*, and shows that the outer system 5 includes a first shell 5*a* and a second shell 5*b* to form the multi-shell construction. Arranged in the outer system 5 is the inner system 6 through which an exhaust flow A flows. Both the insulation sleeve 4 and the inner system 6 extend beyond the flange 3 on one side 7 of the cylinder head Z and project into the cylinder head Z. The insulation sleeve 4 is arranged on a side proximal to the cylinder head Z in circumferential surrounding relationship to one end 8 of the inner system 6 radially outwards and advantageously connected to the end 8 by a press fit 15 (FIG. 3). A gap 9 is formed between the inner system 6 and the insulation sleeve 4 to thermally decouple the projecting end of the inner system 6 from the insulation sleeve 4. Thus, any thermal impact that may be encountered for a short time from the inner system 6 can be compensated and at the same time any peripheral components adjacent to the outer system 5, such as e.g. engine components, are not exposed to a thermal overload. The insulation sleeve 4 is further arranged in the opening 10 of the flange 3 and seats here advantageously again via a press fit 15 (FIG. 3). On the outer side 11 of the flange 3, the insulation sleeve 4 is surrounded in a formfitting manner by an end face 5*a*of the outer system 5, in particular by the first shell 5a of the outer system 5. Advantageously, the first shell 5a of the outer system 5 is connected here to the insulation sleeve 4 again by a press fit 15 (FIG. 3).

FIG. 3 is an enlarged detailed view of the area encircled in FIG. 2 and marked III and shows that the insulation sleeve 4 is provided in relation to its longitudinal direction indicated by arrow 12 with, by way of example, three stepped shoulders 13 which together with the outer system 5 and the flange 3 bound spaces that can serve as solder deposit 14. Solder material may initially be filled in the solder deposit and melt during a soldering process. The gap 9 between the inner system 6 and the insulation sleeve 4 may contain air, or may be filled with gas encountered between the outer system 5 and the inner system 6 during operation of the combustion engine, or may accommodate an insulating material, e.g. a fiber mat. The end of the insulation sleeve 4 distal to the end 8 of the inner system 6 is coupled to the inner system 6. A solder deposit 14 may be provided in this region to solder the inner system 6 with the insulation sleeve 4. As described above, reference numerals 15 refer to the respective press fit at the end of the insulation sleeve 4 with the opening 10 of the flange 3, the respective press fit between the insulation sleeve 4 and the outer system 5, and the respective press fit between the insulation sleeve 4 and the inner system 6 at the end 8 of the inner system 6.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed is:

1. An exhaust manifold for a combustion engine of a motor vehicle, said exhaust manifold comprising:

a two-shell construction comprised of an outer system and an inner system;

a flange positioned at a side of the two-shell construction proximal to a cylinder head of the combustion engine for installation to the combustion engine, said inner system configured in the form of a pipe sized to extend into the flange; and an insulation sleeve configured to connect the inner system with the flange and the outer system, said insulation sleeve being disposed in a circumferential surrounding relationship to the inner system via a press fit and sized to extend through an opening of the flange and to project beyond the flange into the cylinder head of the combustion engine, said outer system having an end face which abuts an outside of the flange, and said insulation sleeve being shaped to seat in the opening of the flange via a press fit.

2. The exhaust manifold of claim 1, wherein the insulation sleeve is connected to the outer and inner systems and the flange by a material joint.

3. The exhaust manifold of claim 1, wherein the insulation sleeve is soldered to the outer and inner systems and the flange.

4. The exhaust manifold of claim 1, wherein the insulation sleeve is configured as a formed sheet metal part.

5. The exhaust manifold of claim 1, wherein the insulation sleeve is configured as a deep-drawn part.

6. The exhaust manifold of claim 1, wherein the insulation sleeve is configured with at least one stepped shoulder in an axial direction defined by a central longitudinal axis, said stepped shoulder providing a formfitting contact or a solder deposit.

7. The exhaust manifold of claim 6, wherein the insulation sleeve is configured with two of said stepped shoulder.

8. The exhaust manifold of claim 1, wherein the insulation sleeve and the inner system define a circumferential gap there between, said gap being filled with air or an insulating material.

9. The exhaust manifold of claim 1, wherein the insulation sleeve has a wall thickness of less than 2 mm.

10. The exhaust manifold of claim 1, wherein the insulation sleeve has a wall thickness of less than 1.5 mm.

* * * * *